US010170873B2

(12) United States Patent
Clark et al.

(10) Patent No.: US 10,170,873 B2
(45) **Date of Patent: *Jan. 1, 2019**

(54) ILLUMINATED LATCH RELEASE FOR CABLE

(71) Applicant: International Business Machines Corporation, Armonk, NY (US)

(72) Inventors: Mark G. Clark, Rochester, MN (US); Kenneth E. Lubahn, Oronoco, MN (US); Justin C. Rogers, Rochester, MN (US); Sandra J. Shirk/Heath, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/801,843

(22) Filed: Nov. 2, 2017

(65) Prior Publication Data

US 2018/0198244 A1 Jul. 12, 2018

Related U.S. Application Data

(63) Continuation of application No. 15/404,970, filed on Jan. 12, 2017, now Pat. No. 9,859,666.

(51) Int. Cl.
*H01R 13/627* (2006.01)
*H01R 13/717* (2006.01)
*H01R 13/633* (2006.01)

(52) U.S. Cl.
CPC ..... *H01R 13/7172* (2013.01); *H01R 13/6335* (2013.01)

(58) Field of Classification Search
CPC ..... H01R 13/6335; H01R 13/7172
USPC ..... 439/490, 910, 352, 258
See application file for complete search history.

(56) References Cited

U.S. PATENT DOCUMENTS 5,613,873 A 3/1997 Bell, Jr.
5,741,152 A 4/1998 Boutros
5,885,100 A 3/1999 Talend et al.
5,915,993 A 6/1999 Belopolsky et al.
(Continued)

OTHER PUBLICATIONS

List of IBM Patents or Applications Treated as Related.
U.S. Appl. No. 15/404,970 entitled "Illiminated Latch Release Cable," filed Jan. 12, 2017.

*Primary Examiner* — Abdullah Riyami
*Assistant Examiner* — Nelson R Burgos-Guntin
(74) *Attorney, Agent, or Firm* — Patterson + Sheridan, LLP

(57) ABSTRACT

A cable connector is provided. The cable connector includes a housing with a proximal end and a distal end. The distal end is configured for insertion into a data port of a computer chassis. The proximal end is configured to receive at least one data cable. The cable connector includes a pull tab comprising an optically transparent material. The pull tab includes a body with a distal end connected to the housing and a proximal end extending past the proximal end of the housing. The pull tab includes a shank protruding from the body. The shank includes a polished surface aligned with a light output of the computer chassis when the distal end of the housing is inserted into the data port such that light from the light output enters the shank through the polished surface and is distributed through the transparent material to illuminate the pull tab.

20 Claims, 8 Drawing Sheets

(56) References Cited

U.S. PATENT DOCUMENTS

| | | | | |
|---|---|---|---|---|
| 6,166,900 | A * | 12/2000 | Flynn | G11B 33/08 248/638 |
| 6,319,051 | B1 | 11/2001 | Chang et al. | |
| 6,361,357 | B1 | 3/2002 | Stillwell et al. | |
| 6,483,107 | B1 * | 11/2002 | Rabinovitz | G06F 1/181 250/239 |
| 6,483,712 | B1 | 11/2002 | Oliphant et al. | |
| 6,699,065 | B1 | 3/2004 | Espenshade et al. | |
| 7,137,743 | B2 | 11/2006 | Graham et al. | |
| 7,194,183 | B2 | 3/2007 | Thornton et al. | |
| 7,670,170 | B2 | 3/2010 | Henry | |
| 7,708,586 | B1 * | 5/2010 | Rohde | H01R 13/746 439/490 |
| 8,303,333 | B2 | 11/2012 | Lee | |
| 8,696,377 | B2 * | 4/2014 | Kelsch | H01R 13/6397 200/51.09 |
| 8,986,036 | B2 * | 3/2015 | Lindkamp | G02B 6/4246 439/160 |
| 2006/0080812 | A1 * | 4/2006 | O'Brien | A44B 11/25 24/633 |
| 2009/0291578 | A1 * | 11/2009 | Wu | H01R 9/032 439/258 |
| 2012/0129382 | A1 * | 5/2012 | Regnier | H01R 4/2429 439/421 |
| 2015/0004832 | A1 * | 1/2015 | Homan | H01R 13/717 439/490 |
| 2015/0340818 | A1 * | 11/2015 | Scherer | H01R 13/641 307/125 |
| 2015/0349462 | A1 * | 12/2015 | Ista | H01R 13/62905 439/310 |
| 2016/0126647 | A1 * | 5/2016 | Sunaga | H01R 12/721 439/76.1 |

* cited by examiner

ILLUMINATED LATCH RELEASE FOR CABLE

CROSS-REFERENCE TO RELATED APPLICATIONS

This application is a continuation of U.S. patent application Ser. No. 15/404,970, filed Jan. 12, 2017. The aforementioned related patent application is herein incorporated by reference in its entirety.

BACKGROUND

In certain computing environments, such as a symmetrical multi-processing chassis environment, computer processing unit (CPU) modules are connected together using data cables, such as active cables. For proper functioning, the data cables must be completely inserted into the correct ports of the CPU modules. To facilitate identification of the correct port for insertion, the ports include lights that can be illuminated. However, in certain instances, the volume of cables for a port may make it difficult for a cable installer to visually identify the ports and/or to verify that a data cable is fully inserted into the port.

SUMMARY

According to one embodiment of the present invention, a cable connector comprises a housing comprising a proximal end and a distal end. The distal end is configured for insertion into and electrical coupling with a data port of a computer chassis. The proximal end is configured to receive at least one data cable. The cable connector also comprises a pull tab comprising an optically transparent material. The pull tab further comprises a body comprising a distal end connected to the housing and a proximal end extending past the proximal end of the housing. The pull tab further comprises a shank protruding from the body. The shank comprises a polished surface that is aligned with a light output of the computer chassis when the distal end of the housing is inserted into the data port of the computer chassis such that light from the light output enters the shank through the polished surface and is distributed through the optically transparent material of the body and the shank to illuminate the pull tab.

According to one embodiment of the present invention, a data transmission apparatus comprises at least one data cable configured to electronically transmit data and a first cable connector arranged at a first end of the at least one data cable. The first cable connector comprises a housing comprising a proximal end and a distal end. The distal end is configured for insertion into and electrical coupling with a data port of a computer chassis, and wherein the first end of the at least one cable is inserted into the proximal end. The first cable connector also comprises a pull tab comprising an optically transparent material. The pull tab further comprises a body comprising a distal end connected to the housing and a proximal end extending past the proximal end of the housing. The pull tab also comprises a shank protruding from the body. The shank comprises a polished surface that is aligned with a light output of the computer chassis when the distal end of the housing is inserted into the data port of the computer chassis such that light from the light output enters the shank through the polished surface and is distributed through the optically transparent material of the body and the shank to illuminate the pull tab.

According to one embodiment of the present invention, a computer system comprises a computer chassis with a data port configured to receive a cable connector of a data cable. The data port includes a light output arranged adjacent to the data port. The computer system also comprises a data cable. The data cable comprises at least one cable configured to transmit electronic data. The data cable also comprises a housing comprising a proximal end and a distal end. The distal end is inserted into and electrically coupled with the data port of the computer chassis. An end of the at least one cable extends from the proximal end. The data cable also comprises a pull tab comprising an optically transparent material. The pull tab further comprises a body comprising a distal end connected to the housing and a proximal end extending past the proximal end of the housing. The pull tab further comprises a shank protruding from the body, wherein the shank comprises a polished surface that is aligned with the light output such that light from the light output enters the shank through the polished surface and is distributed through the optically transparent material of the body and the shank to illuminate the pull tab.

DETAILED DESCRIPTION

Figure 1A:
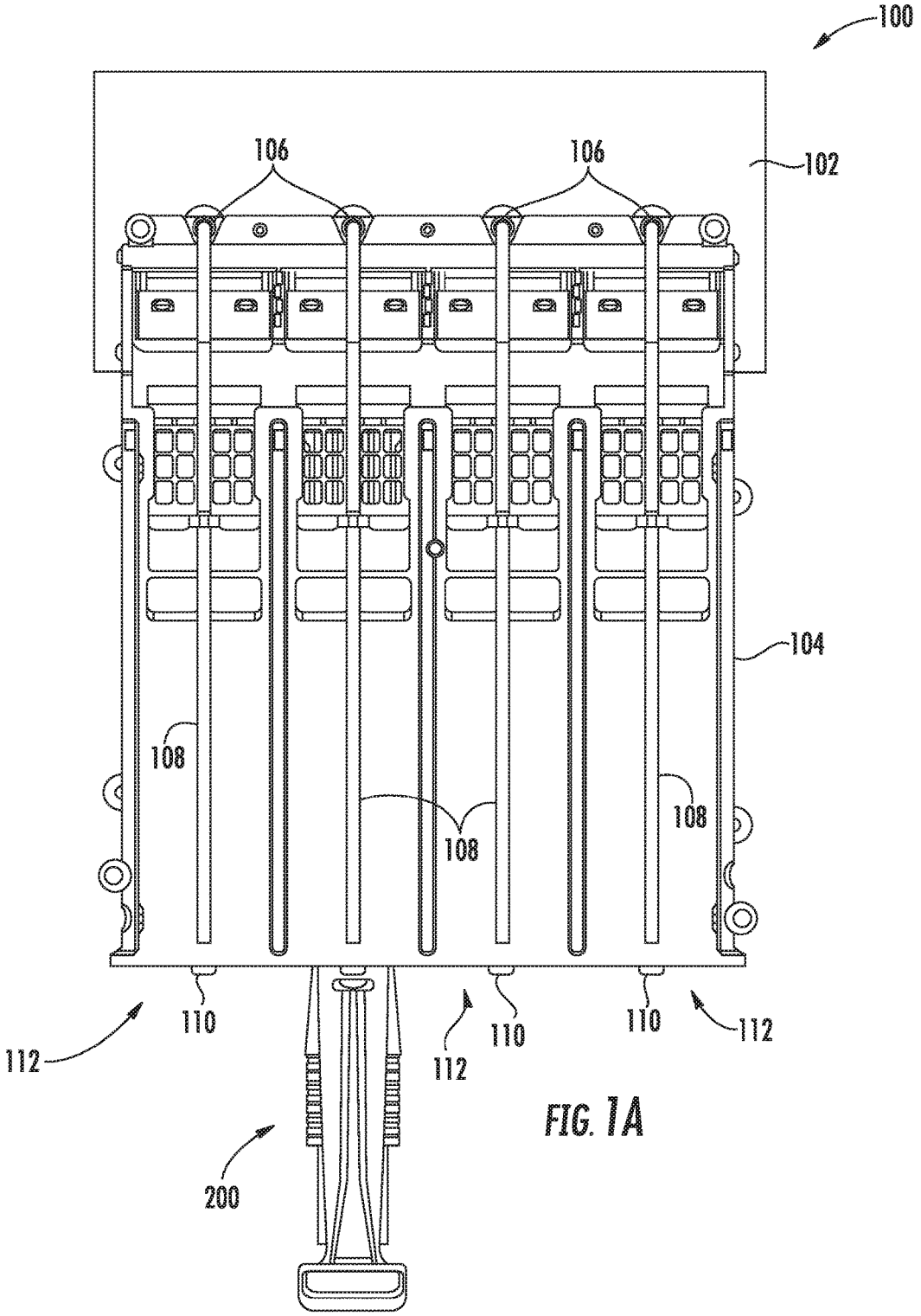
FIG. 1A is a top view of a computer chassis of a computer system with four data ports, wherein a cable connector of a data cable according to at least one embodiment is inserted into one of the ports.
Figure 1B:
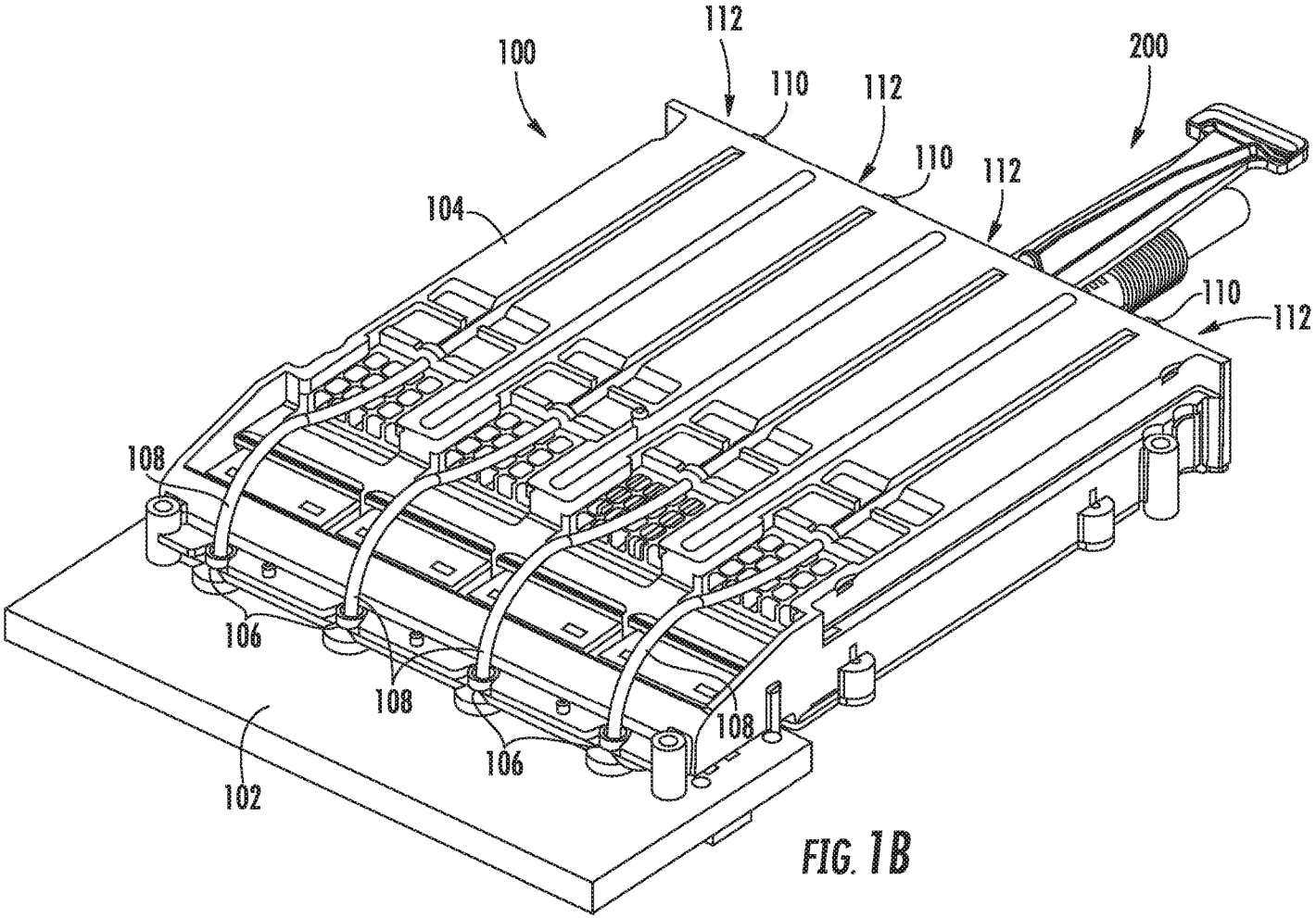
FIG. 1B is a rear perspective view of the computer chassis and data cable of FIG. 1A.
Figure 1C:
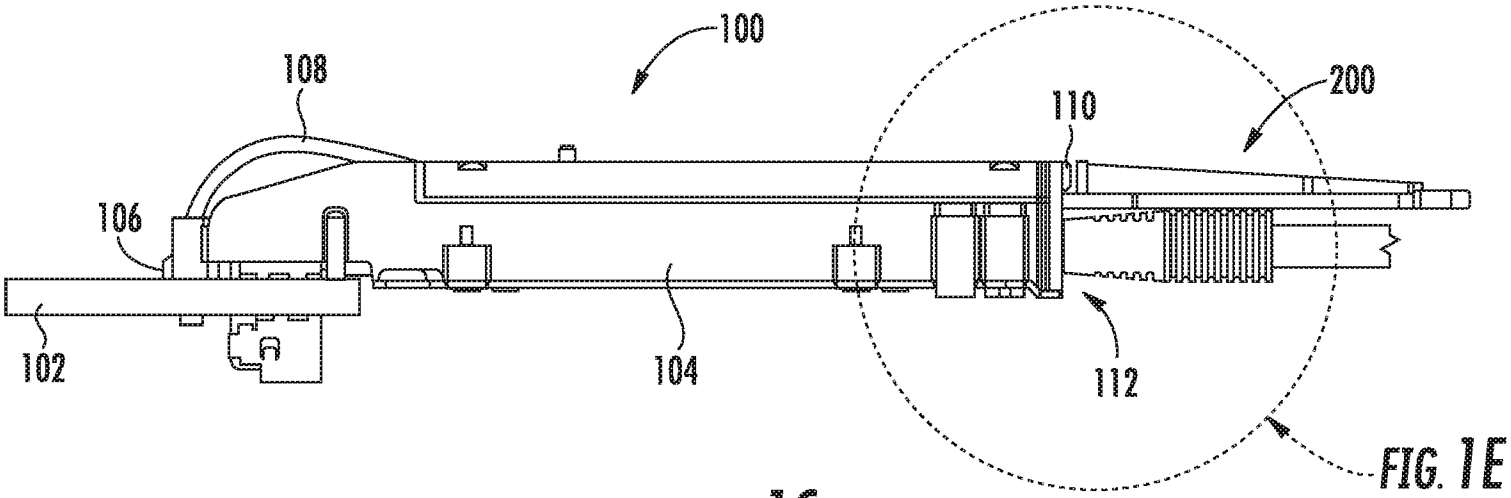
FIG. 1C is a side view of the computer chassis and data cable of FIG. 1A.
Figure 1D:
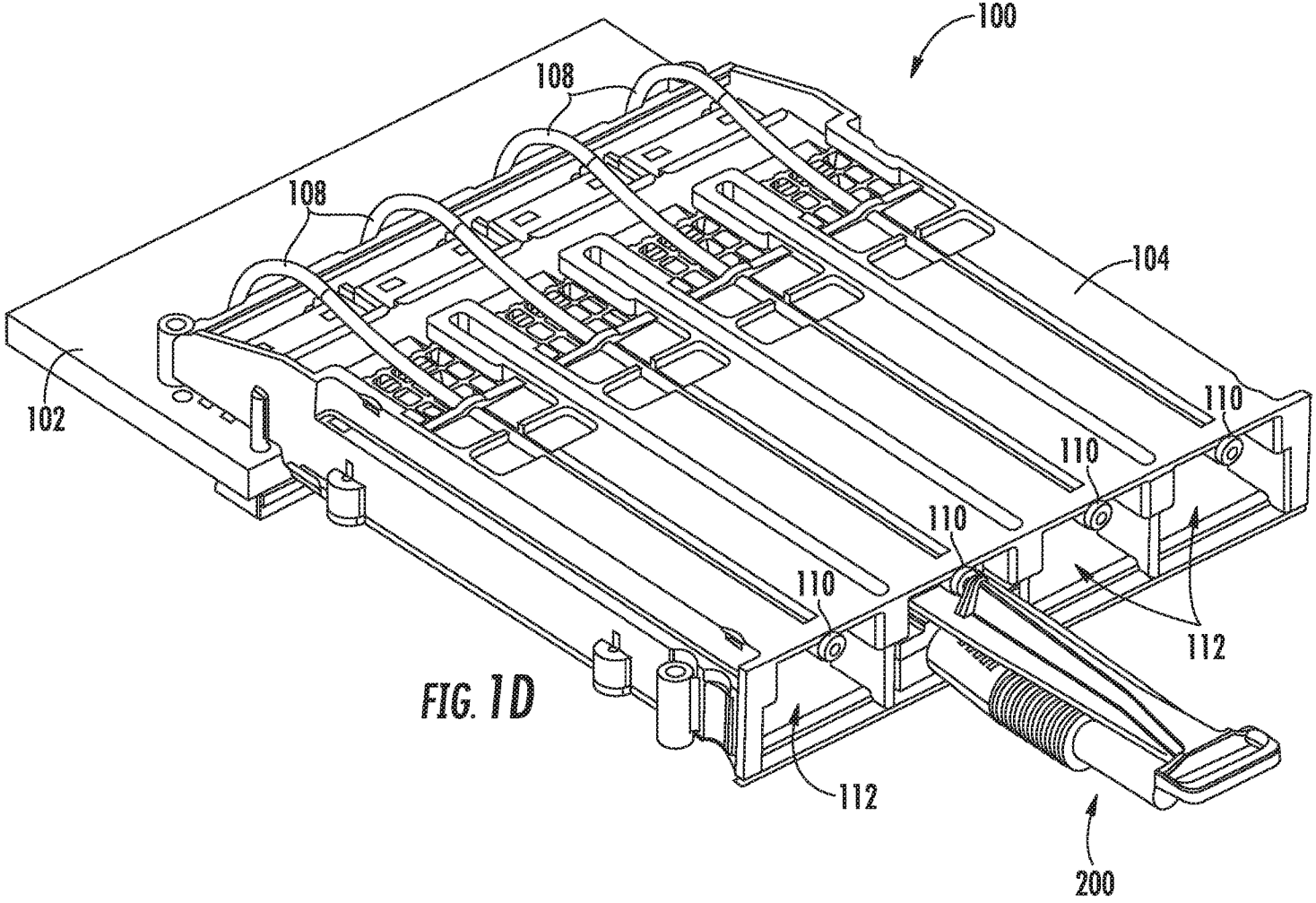
FIG. 1D is a front perspective view of the computer chassis and data cable of FIG. 1A.
Figure 1E:
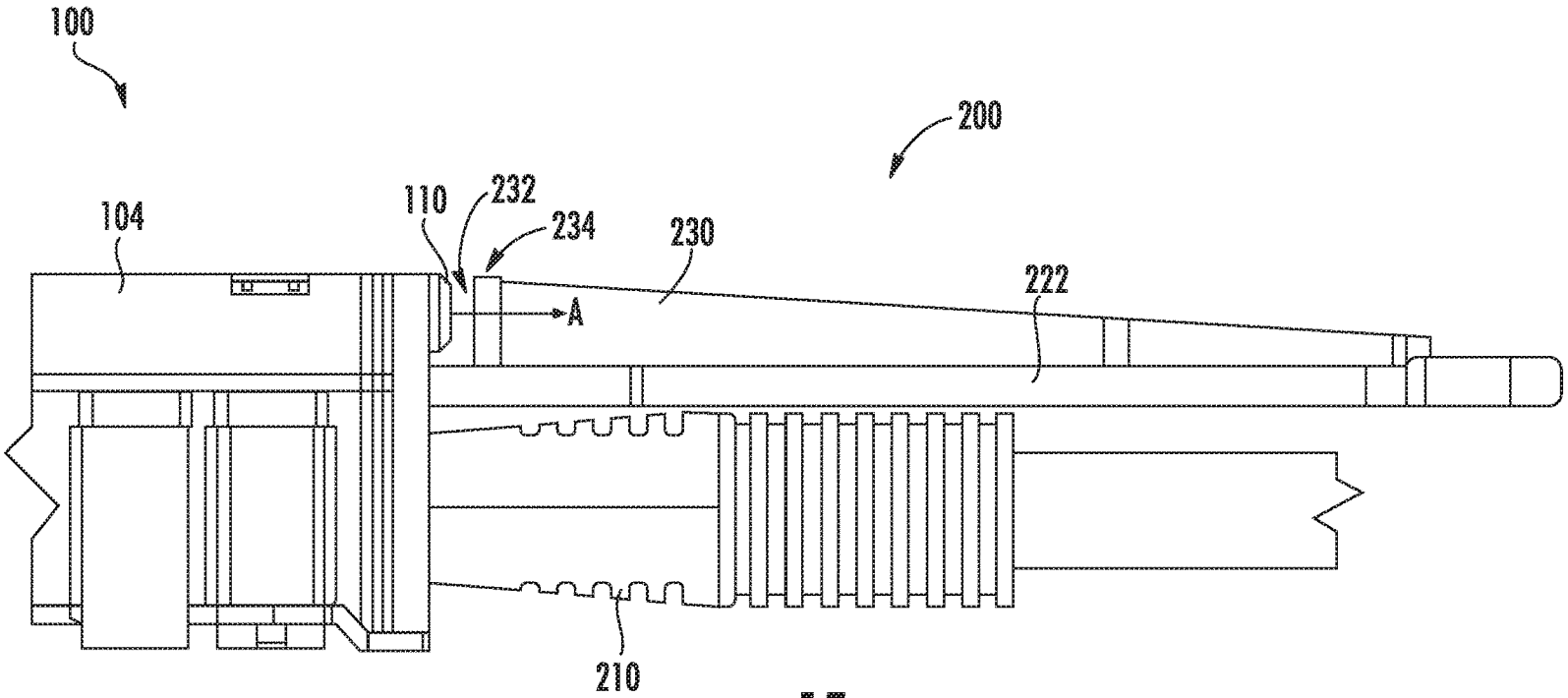
FIG. 1E is a detail side view of the computer chassis and data cable of FIG. 1A.

In the following, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the following aspects, features, embodiments and advantages are merely illustrative and are not considered elements or limitations of the appended claims except where explicitly recited in a claim(s). Likewise, reference to "the invention" or "the disclosure" shall not be construed as a generalization of any inventive subject matter disclosed herein and shall not be considered to be an element or limitation of the appended claims except where explicitly recited in a claim(s).

In embodiments described herein, data cables include translucent latch release mechanisms that can be illuminated by light from a light pipe, optical fiber, or light source associated with a data port of a computer chassis when the connector for the data cable is properly installed in the data port. The translucent latch release mechanism extends from the data port to a location that may be visible to a worker installing data cables, replacing data cables, or diagnosing problems, for example. The translucent latch release is illuminated by the light from the light pipe, optical fiber, or light source, and the worker can verify proper connection to a data port by such illumination.

FIGS. 1A-1E are various views of a cable connector 200 of a data cable inserted into a data port 112 of a computer chassis 104 of a data transmission apparatus 100. The data transmission apparatus 100 includes the computer chassis 104, which is connected to a printed circuit board 102. The printed circuit board 102 may be a part of or be connected to a CPU module in a computer chassis, for example. The printed circuit board 102 includes a plurality of light outputs 106 arranged thereon. Generally, the light outputs 106 are arranged relative to the data ports 112 of the computer chassis 104. For example, in the embodiment shown in FIGS. 1A-1E, the illustrated four light outputs 106 are aligned with respective ones of the illustrated four data ports 112. In at least one embodiment, the light outputs 106 are light emitting diodes (LEDs), incandescent bulbs, lasers, or other light emitting apparatuses.

The data transmission apparatus 100 also includes optical fibers 108 (or light pipes) that transmit light from the light outputs 106 to the data ports 112. First ends of the optical fibers 108 are optically coupled to respective ones of the light outputs 106 and second ends of the optical fibers 108 terminate at the data ports 112. When the light outputs 106 are activated, light generated by the light outputs 106 is transmitted into the optical fibers 108. The transmitted light is transmitted out of the second ends 110 of the optical fibers 108 such that it is visible. The light outputs 106 may be illuminated in a number of different circumstances. For example, if a cable connector 200 for a data cable is to be inserted into a particular data port 112, then the light output 106 associated with that data port 112 may be illuminated to provide a visual indication of the correct data port 112 for the cable connector 200. As another example, the light output 106 associated with a particular data port 112 may be illuminated to provide a visual indication that a good connection with a cable connector 200 has been made.

Figure 2A:
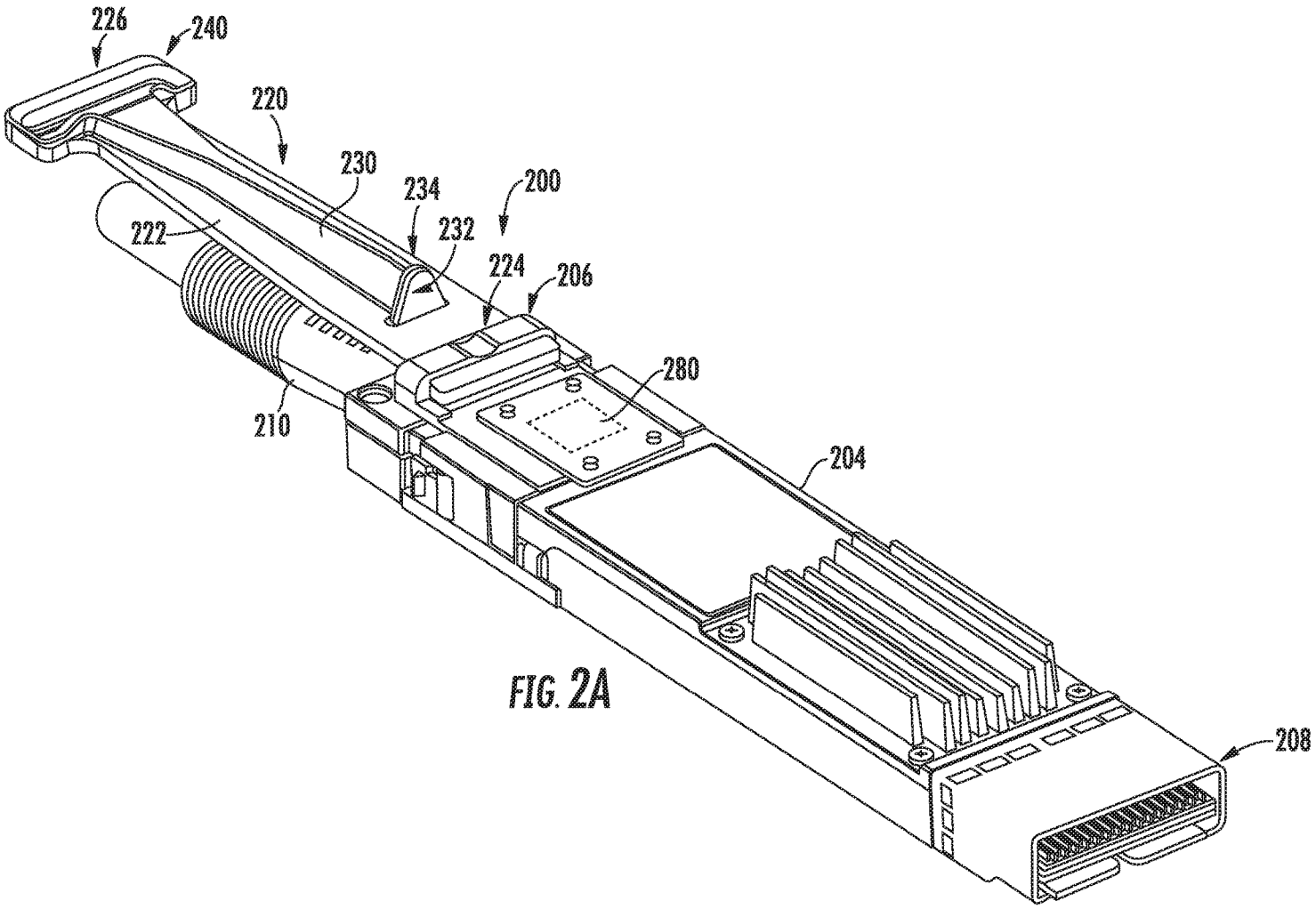
FIG. 2A is a perspective view of a connector end of the data cable of FIG. 1A.
Figure 2B:
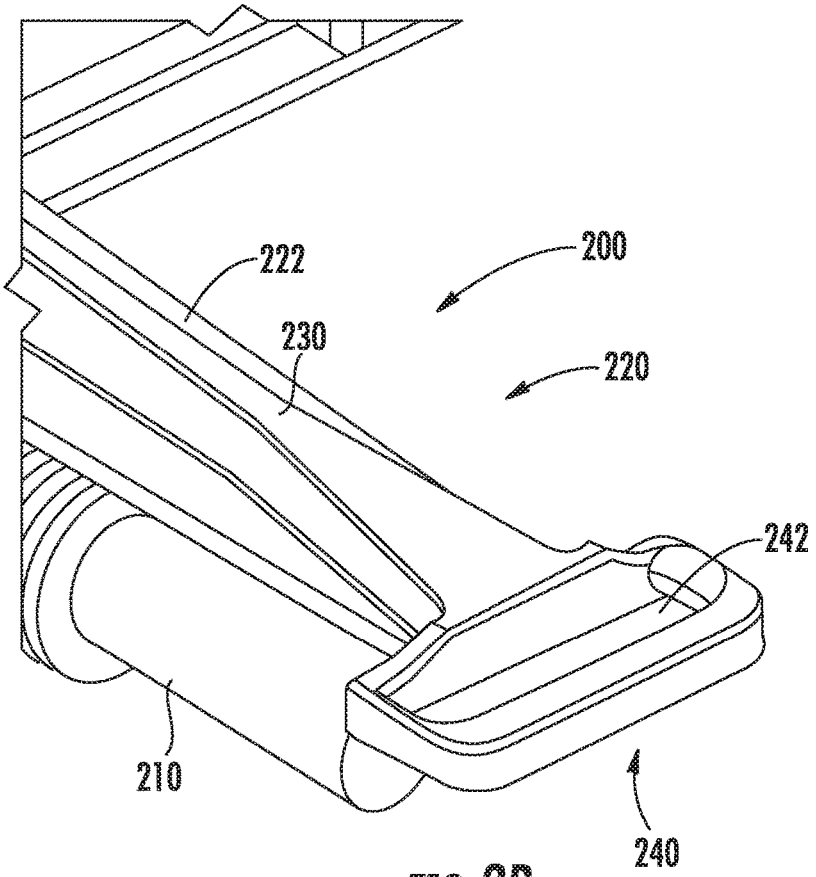
FIG. 2B is a perspective view of a handle of a pull tab, according to one embodiment, of the connector end of FIG. 2A.

FIGS. 2A and 2B illustrate a cable connector 200 configured to be coupled to a data port 112 of the computer chassis 104. The cable connector 200 includes a housing 204 with a proximal end 206 and a distal end 208. The distal end 208 is configured for insertion into a data port 112 of the computer chassis 104. When inserted into the data port 112, the housing 204 is electrically coupled to the data port 112 such that electrical signals transmitting data can pass from the housing 204 to the data port 112 or from the data port 112 to the housing 204. The proximal end 206 of the housing 204 is configured to receive at least one data cable 210 that transmits the data. In various embodiments, the at least one data cable 210 could be a fiber-optic cable or copper wire. In at least one embodiment, the housing 204 includes at least one electronic component 280 arranged therein. For example, the cable connector 200 could be a cable connector for an active cable, and the at least one electronic component 280 could be a semiconductor chip that performs signal processing operations on electrical signals transmitted to or from the data port 112. For example, such a semiconductor chip could perform equalization and/or de-skew operations on such electrical signals. In various other embodiments, the at least one electronic component 280 could include an amplifier, a filter, or other electrical signal processing components. In embodiments in which the data cable 210 is a fiber-optic cable, the at least one electronic component 280 could convert optical signals from the data cable 210 to electrical signals for transmission to the data port 112 and could also convert electrical signals from the data port 112 to optical signals for transmission on the fiber-optic cable.

The cable connector 200 includes a pull tab 220 comprising an optically transparent material, such as acrylic or a polycarbonate material. The pull tab 220 includes a body 222, and a distal end 224 of the body 222 is connected to the housing 204. In the embodiment shown in FIG. 2A, the distal end 224 of the body 222 is connected to the proximal end 206 of the housing 204. A proximal end 226 of the body 222 extends from the proximal end 206 of the housing 204. Returning to FIG. 1D, when the housing 204 is inserted into the data port 112, the body 222 of the pull tab 220 extends away from the computer chassis 104 such that a user can grasp the pull tab 220.

The pull tab 220 also includes a shank 230 protruding from the body 222. The shank 230 includes a polished surface 232 at a distal end 234 of the shank 230. Returning to FIG. 1E, when the housing 204 is inserted into the data port 112 of the computer chassis 104, the polished surface 232 is aligned with the second end 110 of the optical fiber 108 of the data port 112 (and is therefore aligned with the light output 106 of the data port 112, which is also aligned with the optical fiber 108). Light output from the second end 110 of the optical fiber 108 enters the distal end 234 of the shank 230 through the polished surface 232 and is distributed through the transparent material of the shank 230 and the body 222 to illuminate the pull tab 220. In the embodiment shown in FIG. 1E, the second end 110 of the optical fiber 108 and the polished surface 232 of the shank 230 are separated by a gap. Such an air gap may lead to reflections when the light transmitted out of the second end 110 of the optical fiber 108 into the air gap (a first change in index of refraction) and when the light is transmitted from the air gap into the shank 230 through the polished surface (a second change in index of refraction). In at least one embodiment, the polished surface 232 of the shank 230 may contact the second end 110 of the optical fiber 108 when the cable connector 200 is fully inserted into the data port 112. Such contact between the polished surface 232 and the second end 110 of the optical fiber 108 may results in a single change of index of refraction from that of the optical fiber 108 to the polished surface 2332 of the shank 230, thereby reducing reflections and improving optical coupling there-between.

In at least one embodiment, at least portions of exterior surfaces of the body 222 and/or shank 230 of the pull tab 220 include textured surfaces. Such textured surfaces scatter light passing out of the transparent material of the pull tab 220. In at least one embodiment, the pull tab 220 is formed by an injection molding process, and the exterior texturing may be formed in the mold. Stated differently, surfaces of the mold could include a texture pattern that is formed on surfaces of the molded pull tabs 220. In at least one other embodiment, texturing on exterior surfaces of the pull tab 220 is formed after such a molding (or other forming) process. For example, exterior surfaces of the pull tab 220 may be chemically or mechanically etched to form the textured surface.

In at least one embodiment, the body 222 and the shank 230 of the pull tab 220 are made of different materials. For example, the body 222 could be made from a flexible material that may or may not be transparent and the shank 230 could be made a more-rigid material that is optically transparent. The shank 230 and body 222 could be formed separately and then fastened or joined together. For example, the shank 230 and the body 222 could be screwed, riveted, heat staked, ultrasonically welded, or glued together after being formed. By forming the shank 230 and body 222 of the pull tab 220 from separate materials, the material of the body 222 may have better flexibility, enabling an improved degree of compliance during handling. Additionally, the material of the shank 230 may have improved optical clarity.

In at least one embodiment, the pull tab 220 further includes a handle 240 extending from a proximal end 226 of the body 222. The handle 240 is also made from an optically transparent material such that the handle 240 is illuminated by the light from the second and 110 of the optical fiber 108 that entered the body 222 of the pull tab 220. In at least one embodiment, the body 222, the shank 230, and the handle 240 of the pull tab 220 are unitary or monolithic. For example, such a monolithic pull tab 220 could be formed through the above-described injection molding process. In other embodiments, the monolithic pull tab 220 could be formed by machining a block or slug of transparent material. In embodiments in which the body 222 and shank 230 are formed separately and then joined together, the handle 240 may be formed with the body 222 or with the shank 230. Alternatively, the handle may be formed separately from the body 222 and the shank 230 and then fastened or joined to the body 222 and/or shank 230. For example, the handle 240 could be screwed, riveted, heat staked, ultrasonically welded, or glued to the body 222 and/or shank 230. Referring to FIG. 2B, in at least one embodiment, the handle 240 includes an aperture 242. The aperture 242 is configured (i.e., sized) to receive at least a portion of a fingertip of a user. Such an aperture 242 may help the user to grip the handle 240 to insert or remove the cable connector 200 from a data port 112.

Figure 2C:
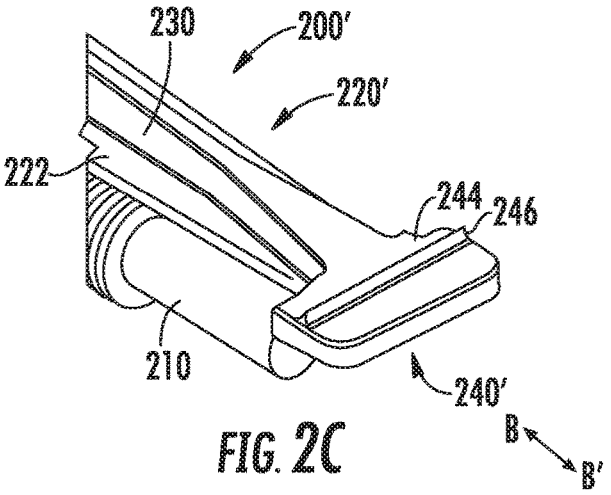
FIG. 2C is a perspective view of a handle of a pull tab, according to another embodiment, of the connector end of FIG. 2A.

FIG. 2C illustrates another embodiment of a handle 240' in which the handle 240' comprises a tab 244 with at least one ridge 246 thereon. The illustrated ridge 246 is generally perpendicular to arrows B and B', which represent directions for insertion and removal, respectively, of the cable connector 200 with respect to the data port 112. The ridge 246 provides a gripping surface for a fingertip of a user to facilitate insertion or removal of the cable connector 200 from a data port 112. In various other embodiments, the ridge(s) could include a pattern, such as a curved pattern, a sinusoidal pattern, a saw tooth pattern, or a square wave pattern. Such patterns may provide additional surface area and additional traction between the fingertip of the user and the ridge 246 to further facilitate insertion or removal of the cable connector 200 from a data port 112.

Figure 3A:
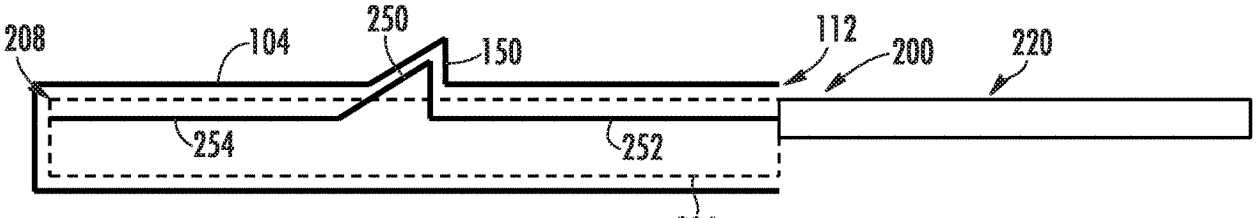
FIG. 3A is a schematic side view of an embodiment of the chassis of FIG. 1A, in which the ports include notches, and wherein the cable connector includes a latch engaged in the notch.
Figure 3B:
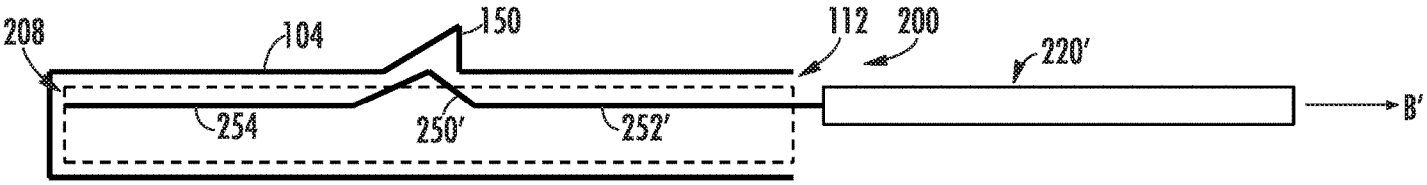
FIG. 3B is a schematic side view of an embodiment of the chassis of FIG. 3A, wherein the cable connector latch is disengaged from the notch.

In at least one embodiment, the cable connector 200 includes a latch, which engages a notch in the data port 112 to prevent the cable connector 200 from disengaging from the data port 112, and pulling on the pull tab 220 (in the direction of arrow B' shown in FIG. 2C) disengages the latch. FIGS. 3A and 3B are schematic side views of a data port 112 with a housing 204 of the cable connector 200 arranged therein. Referring to FIG. 3A, the cable connector 200 includes a latch 250 engaged with (e.g., extending into) a notch 150 in the data port 112. Engagement of the latch 250 with the notch 150 prevents the cable connector 200 from being inadvertently dislodged from the data port 112. The latch 250 is connected to the pull tab 220 by a latch actuating mechanism 252. In the exemplary embodiment illustrated in FIGS. 3A and 3B, the latch 250 and the latch actuating mechanism 252 is a resilient material, such as a sheet metal strip 254 (e.g., spring steel) that is bent to form the latch 250 and the latch actuating mechanism 252. When a tensile force is applied to the sheet metal strip 254, the latch 250 partially unfolds to disengage from the notch 150. When the tensile force is removed, the latch 250 returns to the folded state. The latch actuating mechanism 252 is attached to the pull tab 220 and an end of the sheet metal strip 254 opposite the latch actuating mechanism 252 is attached to the distal end 208 of the housing 204 of the cable connector 200. Referring primarily to FIG. 3 B, when the pull tab 220 is pulled in the direction of arrow B', the pull tab 220 moves in the direction of arrow B' relative to the housing 204 of the cable connector 200. The displaced pull tab 220 is indicated by reference numeral 220'. Displacement of the pull tab 220' urges the latch actuating mechanism 252 in the direction of arrow B', as indicated by reference numeral 252', applying a tensile force to the latch 250. As a result, movement of the latch actuating mechanism 252 in the direction of arrow B' causes the latch 250 to deform (e.g., unfold), as indicated by reference numeral 250'. In the deformed state, the latch 250' disengages from the notch 150 in the data port 112, enabling the cable connector 200 to be removed from the data port 112.

Figure 4:
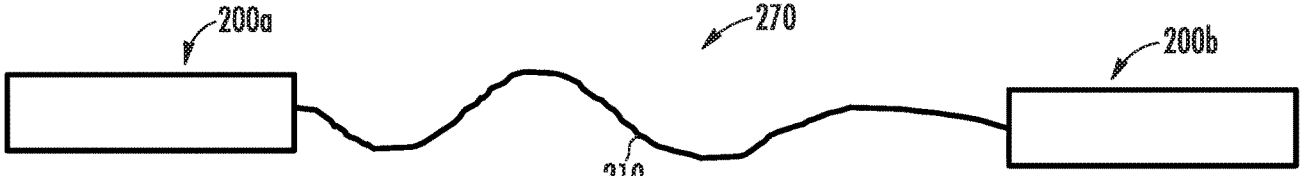
FIG. 4 is a schematic view of a data cable with cable connectors of FIG. 2A at both ends.

Referring now to FIG. 4, in at least one embodiment, a data transmission apparatus 270 includes at least one data cable 210 with cable connectors 200 at respective ends. The data transmission apparatus 270 illustrated in FIG. 4 includes a first cable connector **200*a* at a first end of the at least one data cable 210 and a second cable connector 200*b* at a second end of the at least one data cable 210. As discussed above, the at least one data cable 210** could be one or more fiber optic cable and/or one or more copper wire cables.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

While the foregoing is directed to embodiments of the present disclosure, other and further embodiments of the invention may be devised without departing from the basic scope thereof, and the scope thereof is determined by the claims that follow.

What is claimed is:

1. A cable connector, comprising:

a housing comprising a proximal end and a distal end, wherein the distal end is configured for insertion into and electrical coupling with a data port of a computer chassis, and wherein the proximal end is configured to receive at least one data cable;

a pull tab connected to the housing and comprising an optically transparent material, the pull tab including a polished surface that is aligned with a light output of the computer chassis when the distal end of the housing is inserted into the data port of the computer chassis such that light from the light output enters through the polished surface and is distributed through the optically transparent material of the pull tab to illuminate the pull tab.

2. The cable connector of claim 1, wherein at least portions of surfaces of the pull tab comprise textured surfaces that scatter light passing through the optically transparent material.

3. The cable connector of claim 1, wherein the pull tab further comprises a handle extending from a proximal end of the pull tab, and wherein the handle comprises the optically transparent material such that the handle is illuminated by the light distributed through the optically transparent material.

4. The cable connector of claim 3, wherein the handle comprises an aperture configured to receive at least a portion of a fingertip therethrough.

5. The cable connector of claim 3, wherein the handle comprises a tab with at least one ridge thereon.

6. The cable connector of claim 1, wherein the housing includes a latch configured to engage a notch in the data port, wherein the distal end of the pull tab is connected to a latch actuating mechanism such that applying a force on the pull tab in a proximal direction actuates the latch actuating mechanism to disengage the latch from the notch.

7. The cable connector of claim 1, further comprising at least one electronic component arranged in the housing, wherein the at least one electronic component is operable to modify electronic data transmitted through the cable connector.

8. A data transmission apparatus, comprising:

at least one data cable configured to electronically transmit data; and a first cable connector arranged at a first end of the at least one data cable, the first cable connector comprising:

a housing comprising a proximal end and a distal end, wherein the distal end is configured for insertion into and electrical coupling with a data port of a computer chassis, and wherein the first end of the at least one data cable is inserted into the proximal end of the housing;

a pull tab connected to the housing and comprising an optically transparent material, the pull tab including a polished surface that is aligned with a light output of the computer chassis when the distal end of the housing is inserted into the data port of the computer chassis such that light from the light output enters through the polished surface and is distributed through the optically transparent material of the pull tab to illuminate the pull tab.

9. The data transmission apparatus of claim 8, further comprising a second cable connector arranged at a second end of the at least one data cable, the second cable connector comprising:

a second housing comprising a proximal end and a distal end, wherein the distal end is configured for insertion into and electrical coupling with a data port of a computer chassis, and wherein the second end of the at least one data cable is inserted into the proximal end of the second housing;

a second pull tab connected to the second housing and comprising an optically transparent material, the second pull tab including a polished surface that is aligned with a light output of the computer chassis when the distal end of the second housing is inserted into the data port of the computer chassis such that light from the light output enters through the polished surface and is distributed through the optically transparent material of the second pull tab to illuminate the second pull tab.

10. The data transmission apparatus of claim 8, wherein at least portions of surfaces of the pull tab comprise textured surfaces that scatters light passing through the optically transparent material of the pull tab.

11. The data transmission apparatus of claim 8, wherein the pull tab further comprises a handle extending from the proximal end thereof, and wherein the handle comprises the optically transparent material such that the handle is illuminated by the light distributed through the optically transparent material.

12. The data transmission apparatus of claim 11, wherein the handle comprises an aperture configured to receive at least a portion of a fingertip therethrough.

13. The data transmission apparatus of claim 11, wherein the handle comprises a tab with at least one ridge thereon.

14. The data transmission apparatus of claim 8, wherein the housing includes a latch configured to engage a notch in the data port, wherein the distal end of the pull tab is connected to a latch actuating mechanism such that applying a force on the pull tab in a proximal direction actuates the latch actuating mechanism to disengage the latch from the notch.

15. The data transmission apparatus of claim 8, wherein the at least one cable comprises at least one copper wire bundle.

16. The data transmission apparatus of claim 8, wherein the at least one cable comprises at least one fiber optic cable.

17. A method of coupling a data cable to a computer chassis, comprising:

inserting a cable connector into a data port of the computer chassis, the cable connector including a housing comprising a proximal end and a distal end, wherein the distal end is inserted into and electrically coupled with the data port, and wherein the first end of the data cable is inserted into the proximal end of the housing;

aligning a polished surface of a pull tab of the cable connector with a light output of the computer chassis; and directing light from the light output into the pull tab; and distributing the light from the light output throughout the pull tab.

18. The method of claim 17, wherein the pull tab is optically transparent.

19. The method of claim 18, wherein at least portions of surfaces of the pull tab comprise textured surfaces that scatter light passing through the pull tab.

20. The method of claim 17, further comprising transmitting data cable between the cable and the data port.

* * * * *